United States Patent [19]

Bundschuh

[11] Patent Number: 4,640,444

[45] Date of Patent: Feb. 3, 1987

[54] PUMP DISPENSER WITH SLIDABLE TRIGGER

[76] Inventor: Robert L. Bundschuh, Box 4415, Miami Lakes, Fla. 33014

[21] Appl. No.: 632,083

[22] PCT Filed: Jun. 1, 1984

[86] PCT No.: PCT/US84/00839

§ 371 Date: Jun. 1, 1984

§ 102(e) Date: Jun. 1, 1984

[51] Int. Cl.[4] ..... B67D 5/40; B05B 9/43

[52] U.S. Cl. ..... 222/321; 222/383; 239/333

[58] Field of Search ..... 222/79, 320, 321, 336, 222/340, 341, 372, 379, 380, 381, 383, 409; 239/333

[56] References Cited

U.S. PATENT DOCUMENTS

| | | | |
|---|---|---|---|
| 1,143,839 | 6/1915 | Lefever | 222/79 |
| 1,223,655 | 4/1917 | Arden | 222/79 |
| 2,004,295 | 6/1935 | Rothchild et al. | 299/97 |
| 2,753,578 | 7/1956 | Lebet | 15/133 |
| 2,877,931 | 3/1959 | Goldfarb | 222/79 |
| 3,044,413 | 7/1962 | Corsette | 103/178 |
| 3,102,489 | 9/1963 | Corsette et al. | 103/42 |
| 3,248,021 | 4/1966 | Corsette et al. | 222/321 |
| 3,282,472 | 11/1966 | Roder | 222/321 |
| 3,527,551 | 9/1970 | Kutik et al. | 417/560 |
| 3,877,616 | 4/1975 | Stevens | 222/321 |
| 3,877,617 | 4/1975 | Stevens | 222/321 |
| 4,072,252 | 2/1978 | Steyns et al. | 222/341 |
| 4,159,067 | 6/1979 | Akers | 222/153 |
| 4,249,681 | 2/1981 | French | 222/380 |
| 4,273,268 | 6/1981 | Wickenberg | 222/321 |
| 4,315,582 | 2/1982 | Micallef | 222/148 |
| 4,358,057 | 11/1982 | Burke | 239/333 |
| 4,371,097 | 2/1983 | O'Neill | 222/321 |
| 4,410,107 | 10/1983 | Corsette | 222/321 |
| 4,538,745 | 9/1985 | Dunning et al. | 222/153 |

FOREIGN PATENT DOCUMENTS

| | | | |
|---|---|---|---|
| 2118594 | 4/1972 | Fed. Rep. of Germany | 239/333 |

*Primary Examiner*—Charles A. Marmor
*Assistant Examiner*—Michael S. Huppert
*Attorney, Agent, or Firm*—Roylance, Abrams, Berdo & Goodman

[57] ABSTRACT

A manually-operated pump dispenser (10) for dispensing liquids from a container (28). The dispenser comprises a housing (20), a closure (22) for coupling the housing to a container (28), a pump member (14) having a trigger (84) rigidly extending therefrom and being slidably received in the housing, a coiled spring (16) for biasing the pump member away from the housing, and an adjustable nozzle (12) coupled to the end of the pump member. The pump member and the housing include cooperating slots (86, 89, 90) and flanges (120, 121) and cooperating square portions (71, 115) for resisting the tendency of the pump member to distort about an axis transverse to the housing upon engagement of the trigger (84), thereby maintaining the pump member and the housing in longitudinal alignment. The dispenser includes an inboard valve member (18) received in the housing and an outboard valve (26) formed by the adjustable nozzle (12) and the pump member (14), without the need of an addditional part. The adjustable nozzle (12), pump member (14), inboard valve member (18), housing (20) and closure (22) are each integrally molded as one-piece. The closure (22) is snap-fitted directly onto the housing (20) without the need of an additional part.

29 Claims, 15 Drawing Figures

PUMP DISPENSER WITH SLIDABLE TRIGGER

FIELD OF THE INVENTION

The invention relates to a manually-operated pump dispenser for dispensing liquids from a container. The dispenser is comprised of seven parts including an adjustable nozzle, a pump member having a trigger extending rigidly therefrom, a coiled spring, an inboard valve member, a housing, a closure and a dip tube. The pump member is slidably received in the housing, and both the pump member and the housing include cooperating planar members for resisting the tendency of the pump member to distort about an axis transverse to the housing upon engagement of the trigger, thereby maintaining the housing and the pump member in longitudinal alignment. The pump member and the adjustable nozzle form the outboard valve, without the need of an additional part, and the closure is directly coupled to the housing without an added part.

BACKGROUND OF THE INVENTION

Manually-operated pump dispensers for dispensing liquids from containers have long been known. They are typically in two forms, one being commonly referred to as a trigger sprayer and the other being referred to as a finger pump. In the trigger sprayer, the operator's hand grasps a housing and the operator's index and middle fingers engage a trigger which is pivotally or longitudinally movable towards the housing to dispense liquids from a container coupled to the housing. In the finger pump type of dispenser the operator's hand once again grasps a housing and usually only the operator's index finger engages a vertically slidable pump member that reciprocates in the housing. These dispensers, in either form, thus typically comprise a housing and a movable pumping member with some sort of nozzle at the end of the movable member to dispense the liquid in a spray or stream. To provide the required pumping action, these devices require two one-way, or check, valves along the flow of the liquid and a biasing member to move the pump member away from the housing after it has been moved towards the housing.

While these devices are well known, there is a continued need for improvement in their construction and operation. Thus, many of the prior art devices have numerous parts, are complicated to manufacture, are not reliable since they tend to leak, and are not easily produced by an efficient injection molding process. Moreover, many of these devices have complicated adjustable nozzles and require several parts to couple them to the container.

Examples of these prior art devices are disclosed in the following U.S. patents: U.S. Pat. Nos. 2,004,295 to Rothchild et al; 2,753,578 to Lebet; 3,044,413 to Corsette; 3,102,489 to Corsette et al; 3,248,021 to Corsette; 3,282,472 to Roder; 3,527,551 to Kutik et al; 3,877,616 to Stevens; 4,072,252 to Steyns et al; 4,159,067 to Akers; 4,249,681 to French; 4,273,268 to Wickenberg; 4,315,582 to Micallef; 4,371,097 to O'Neill; and 4,410,107 to Corsette.

SUMMARY OF THE INVENTION

Accordingly, a primary object of the invention is to provide a pump dispenser that has a limited number of parts, is simple to construct and operate, resists leakage and is easily produced by injection molding of its parts.

Another object of the invention is to provide a pump dispenser utilizing a pump member that is slidably engageable with the housing including cooperating members for maintaining the pump member and housing in longitudinal alignment during relative movement therebetween.

Another object of the invention is to provide such a pump dispenser in which an adjustable nozzle combines with the pump member to form the outboard valve.

Another object of the invention is to provide such a pump dispenser with a one-piece closure that is directly coupled to the housing without an added part.

Another object of the invention is to provide such a pump dispenser formed of only seven parts including an integrally molded adjustable nozzle, an integrally molded pump member, an integrally molded housing and an integrally molded closure.

The foregoing objects are basically attained by providing in a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising cooperating substantially planar means on the housing and the pump member for maintaining the pump member and the housing in longitudinal alignment when the trigger is engaged and the pump member is moved towards the housing.

The foregoing objects are also basically attained by providing in a pump dispenser having first means defining a fluid passageway, a dip tube extending from the fluid passageway into a container, second means for coupling the container to the first means, a vent formed in the first means and communicating with the interior of the container, an outboard one-way valve and an inboard one-way valve located along the fluid passageway and defining a product chamber therebetween, a finger engaging element coupled to the first means for movement from a first position to a second position to vary the volume of the product chamber, third means for biasing the finger engaging element from the second position to the first position, a nozzle member, and fourth means for coupling the nozzle member to the first means at the end of the fluid passageway, the improvement comprising the outboard one-way valve being formed by an annular valve seat coupled to one of the nozzle member and first means, and an annular resilient valve member formed integrally with the other of the nozzle member and first means and engaging the valve seat, the fourth means for coupling including means for preventing relative longitudinal movement of the nozzle member and the first means during opening and closing of the outboard one-way valve formed thereby, this fourth means for coupling including means for adjustably coupling the nozzle member and the first means, the nozzle member and the first means having cooperating means for varying the flow of the fluid to be exhausted via the nozzle member upon adjusting the coupling of the nozzle member and the first means.

The foregoing objects are also basically attained by providing in a pump dispenser having first means defining a fluid passageway, a dip tube extending from the fluid passageway into a container, second means for coupling the container to the first means, a vent formed in the first means and communicating with the interior of the container, an outboard one-way valve and an inboard one-way valve located along the fluid passageway and defining a product chamber therebetween, a finger engaging element coupled to the first means for movement from a first position to a second position to vary the volume of the product chamber, third means for biasing the finger engaging element from the second position to the first position, a nozzle member, and fourth means for coupling the nozzle member to the first means at the end of the fluid passageway, the improvement comprising said second means including a support extending integrally and downwardly on the first means and having a substantially cylindrical outer surface with an outwardly facing groove therein having an upwardly facing shoulder, said groove being spaced from the distal end of said cylindrical outer surface, and an annular closure having a cylindrical inner surface with an inwardly facing rib thereon having a downwardly facing shoulder, said rib being received in said groove via a snap-fit so that said upwardly and downwardly facing shoulders engage and so that said cylindrical inner and outer surfaces are closely adjacent one another while allowing relative rotation therebetween, said closure having means thereon for coupling said closure to the container.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

Figure 14:
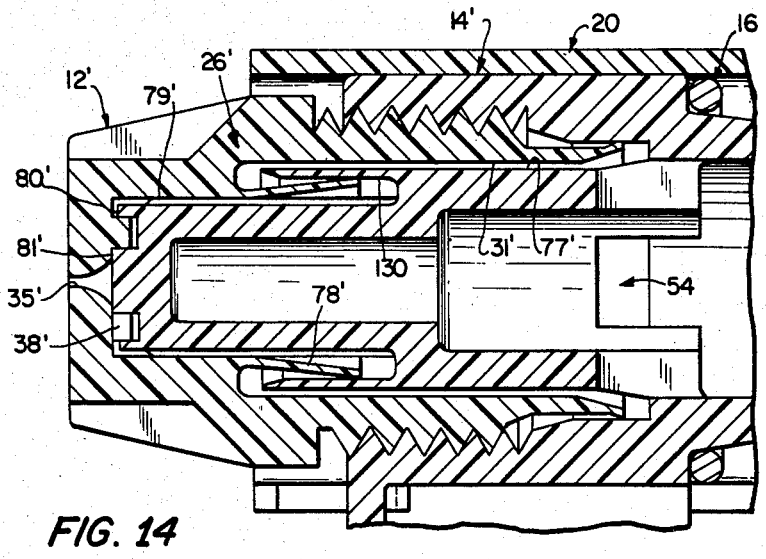
Figure 15:
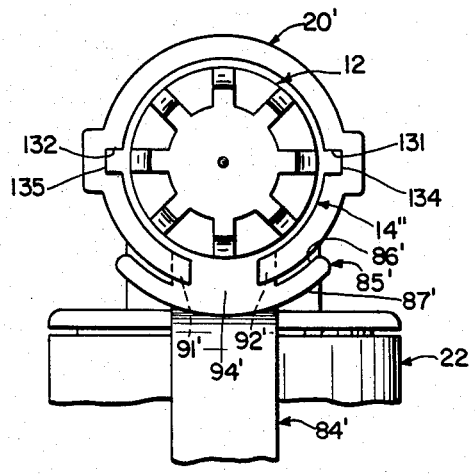

FIG. 14 is an elevational view in longitudinal section of a modified outboard valve embodiment where the valve member is integrally formed with the adjustable nozzle and the valve seat is formed by the pump member; and FIG. 15 is a front elevational view of a modified embodiment of the pump dispenser where the pump member has a pair of outwardly facing flanges that are slidably received in a pair of inwardly facing slots formed in the housing.

DETAILED DESCRIPTION OF THE INVENTION

Figure 1:
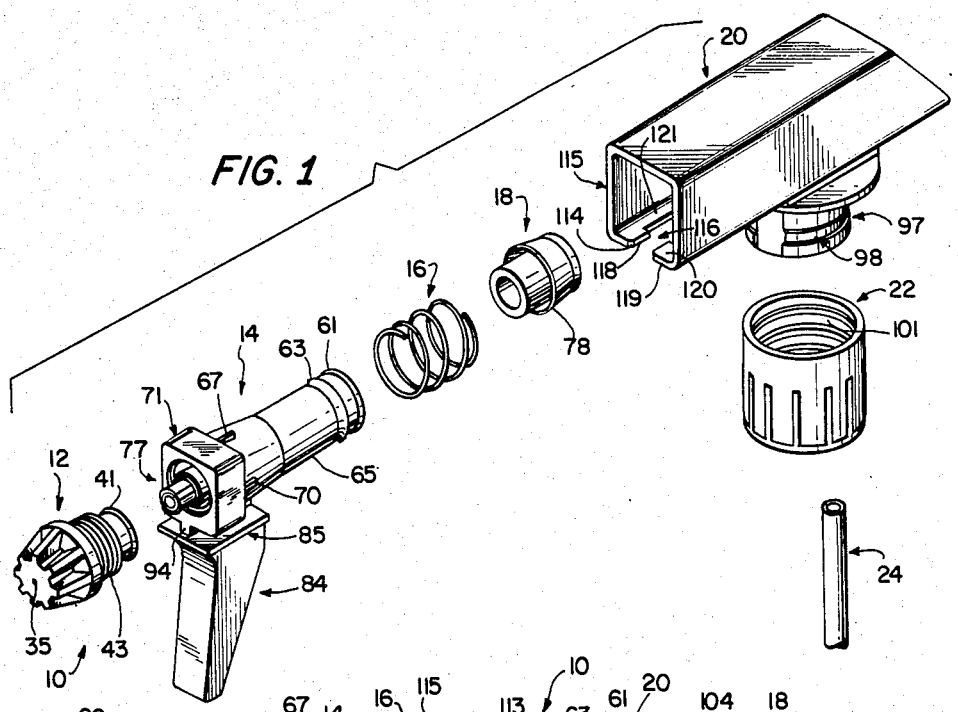
FIG. 1 is an exploded perspective view of the pump dispenser in accordance with the present invention.
Figure 2:
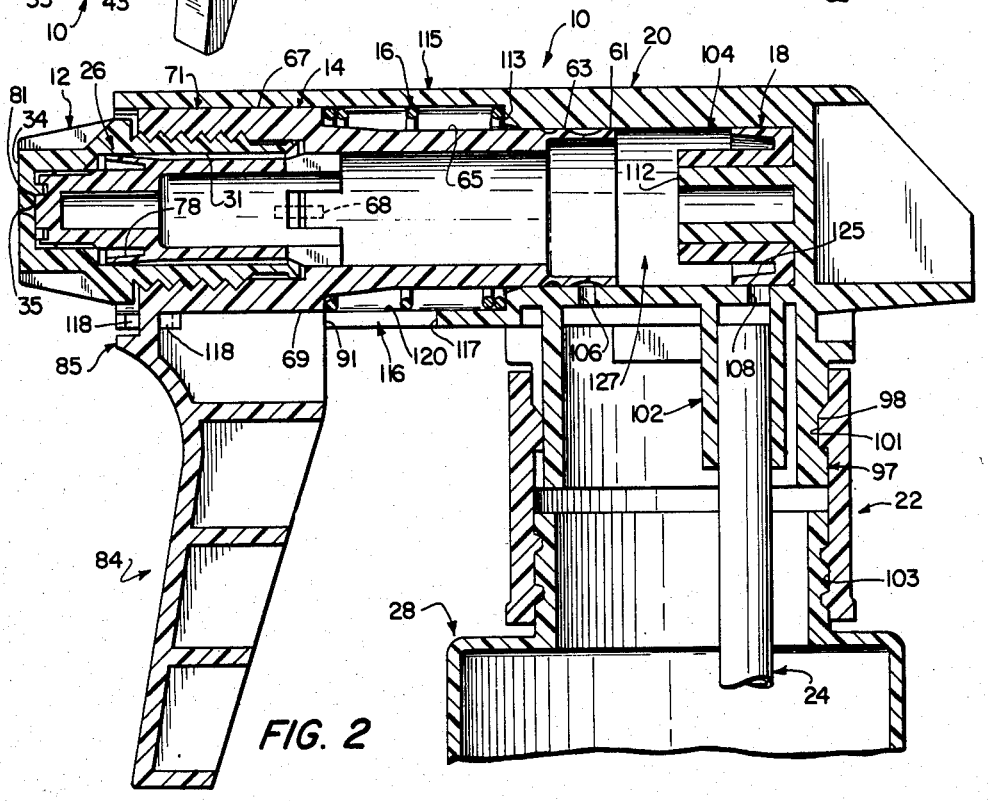
FIG. 2 is an enlarged elevational view in longitudinal section of the pump dispenser shown in FIG. 1, the dispenser being shown in its rest position.

As seen in FIGS. 1 and 2, the pump dispenser 10 in accordance with the invention comprises an adjustable nozzle member 12, a pump member 14, a restoring spring 16, an inboard valve member 18, a housing 20, a closure 22 and a dip tube 24. The nozzle member 12 is threadedly engageable with the pump member, these two members forming an outboard valve 26. The pump member 14 is longitudinally aligned and slidably engageable with the housing, and the inboard valve member 18 is received in the housing which forms the valve seat therefor. The housing 20 is coupled to a container or bottle 28 by means of rotatable snap-on closure 22 and the dip tube 24 extends from the housing into the container.

Figure 12:
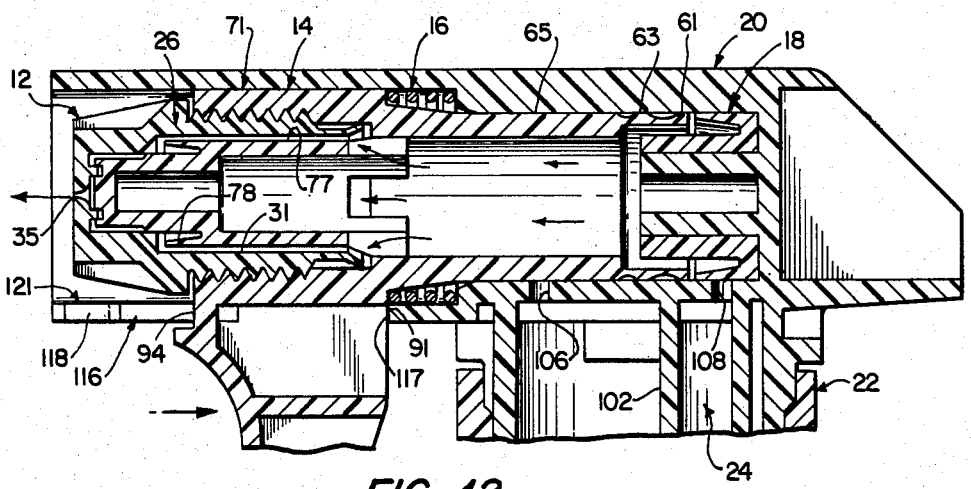
FIG. 12 is an elevational view in longitudinal section of the pump dispenser pumping fluid out of the adjustable nozzle as the pump member is moved towards the housing.

This container has a liquid therein which is dispensed in a stream or spray by means of longitudinal reciprocation of the pump member relative to the housing. This reciprocation is accomplished by the operator gripping the housing and manually engaging the pump member trigger 84 with the index and middle fingers and pumping the pump member relative to the housing. This pumping alternately opens and closes the outboard and inboard valves, resulting in the desired dispensing of the liquid from the container. The restoring force provided to the pump member to move it away from the housing is generated by the potential energy created in the coiled restoring spring 16 as it is longitudinally compressed as the pump member is moved towards the housing as seen in FIG. 12. As used herein, the term liquid is meant to include foams.

Figure 3:
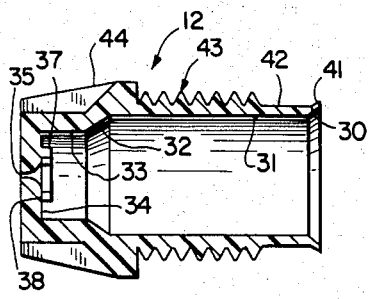
FIG. 3 is an elevational view in longitudinal section of the adjustable nozzle shown in FIGS. 1 and 2.
Figure 10:
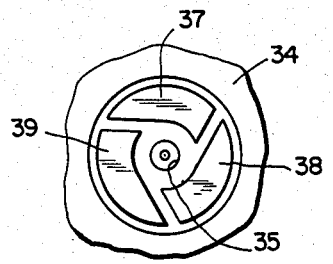
FIG. 10 is an enlarged rear elevational view of the swirl members in the adjustable nozzle shown in FIG. 11.

As seen in FIG. 3, the adjustable nozzle member 12 is formed of a plastic material as a one-piece member by injection molding. From the rear of the nozzle member on the interior, there is an inwardly tapering frustoconical surface 30, a cylindrical surface 31, an inwardly tapering frustoconical surface 32, a cylindrical surface 33 and a vertical end wall 34 having a tapered exit orifice 35 therein. Three swirl members 37, 38 and 39, as best seen in FIG. 10, extend integrally and rearwardly from the end wall 34. These three swirl members are circumferentially space so that fluid can pass radially inwardly thereof and then out the exit orifice 35 as described in more detail hereinafter. As seen in FIG. 10, these swirl members are arranged so that there is a substantially cylindrical cavity formed thereby.

The combination of the inwardly facing surfaces 30–33 in the adjustable nozzle as well as the spaces between the swirl members 37–39 and the exit orifice 35 all combine to form a fluid passageway through the adjustable nozzle.

On the outer surface of the adjustable nozzle is an outwardly facing frustoconical surface 41, a cylindrical surface 42, helical threads 43, and a grooved frustoconical surface 44.

Frustoconical surfaces 30 and 41 on the adjustable nozzle form a lip seal with the pump member as will be described in detail hereinafter. Moreover, the helical threads 43 on the adjustable nozzle provide an adjustable threaded engagement with the pump member, this adjustable coupling via the threaded engagement providing for variation in the pattern of fluid exhausted from the pump dispenser as well as an on-off capability.

Figure 4:
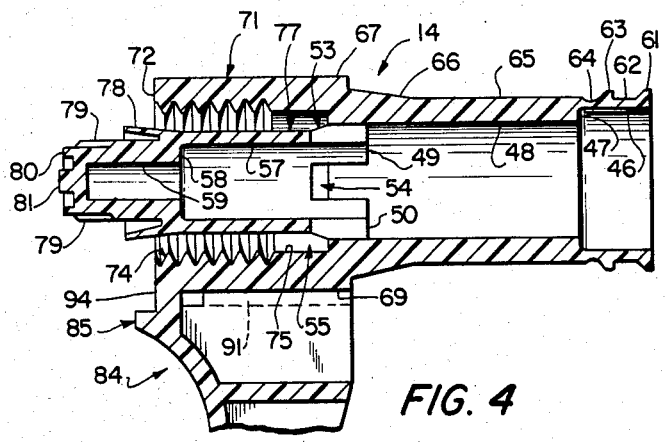
FIG. 4 is an elevational view in longitudinal section of the pump member shown in FIGS. 1 and 2.
Figure 7:
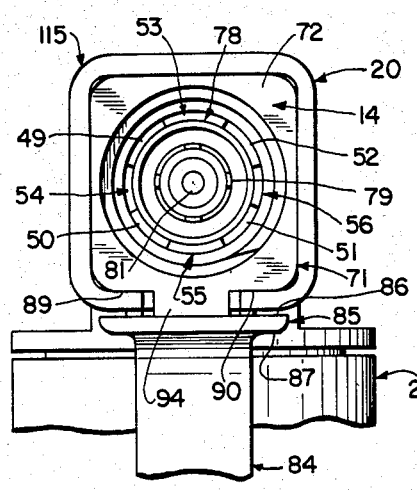
FIG. 7 is a front elevational view of the housing and pump member shown in FIGS. 1 and 2, the pump member being shown without the adjustable nozzle thereon.
Figure 9:
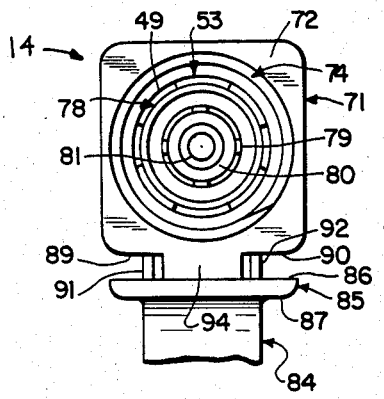
FIG. 9 is a front elevational view of the pump member by itself without the adjustable nozzle thereon.

The pump member 14 as seen in FIG. 4 is also formed from plastic material as a one-piece member by injection molding. From the rear of the pump member on the inner surface there is a cylindrical surface 46, an annular shoulder 47, a cylindrical surface 48, four longitudinally extending struts 49–52 defining four ports 53–56 therebetween, a cylindrical surface 57, an annular shoulder 58 and a cylindrical surface 59. These struts 49–52 are spaced substantially 90 degrees apart and each pair has one of the ports 53–56 therebetween, as also seen in FIGS. 7 and 9.

On the outer surface of the pump member as seen in FIG. 4 are a frustoconical lip seal 61, a cylindrical surface 62, a second frustoconical lip seal 63, an annular groove 64 with a curved cross section, a cylindrical surface 65, an outwardly tapering frustoconical surface 66, four splines 67–70 arranged at 90 degree intervals around the frustoconical surface 76, a square portion 71, and a square end surface 72.

Extending inwardly from the end surface 72 of the square portion 71 are helical threads 74 which are inwardly facing and which threadedly engage helical threads 43 on the adjustable nozzle member. Extending rearwardly from these threads 74 is an inwardly facing cylindrical surface 75 which forms a sealing surface against which the lip seal formed by frustoconical surfaces 30 and 41 in the nozzle member engages.

Figure 11:
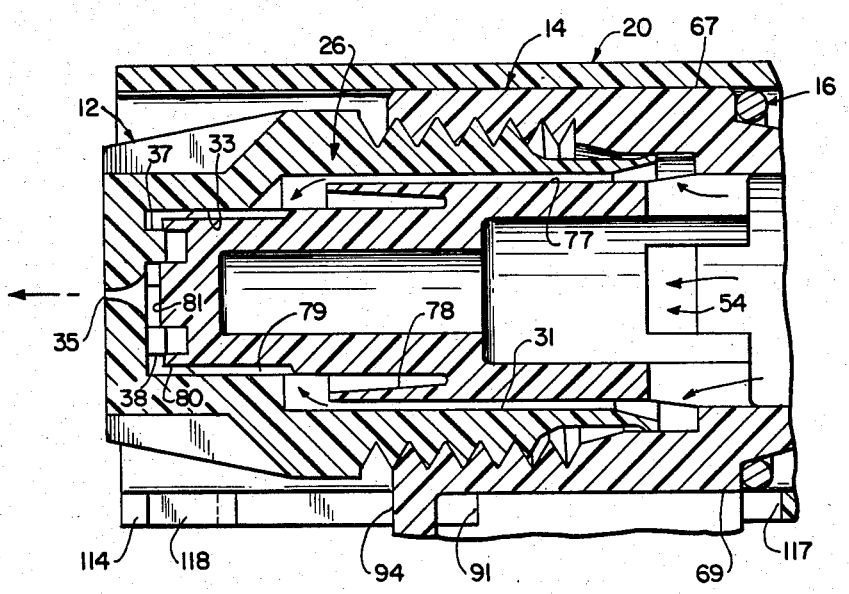
FIG. 11 is an enlarged elevational view in longitudinal section of the outboard valve of the pump dispenser in its open condition, this valve being formed by the adjustable nozzle and the pump member.

Extending inside and spaced from the helical threads 43 and cylindrical surface 75 as extension of the struts 49–52 is a substantially cylindrical stem 77 having an outwardly tapering frustoconical valve member 78 integrally thereon. Forward of the valve member is a cylindrical section with a plurality of spaced splines 79 thereon. At the end of the stem 77 is an annular projection 80 and a cylindrical tip 81 located concentric of the annular projection and central of the stem. As seen in FIG. 11, cylindrical tip 81 can be received inside the cavity defined by the three swirl members 37–39. As seen in FIG. 2 when the cylindrical tip 81 is fully received inside these members and against wall 34, it closes off flow through the exit orifice, thereby completely shutting off flow out of the nozzle member. To vary the pattern of fluid exhausted via orifice 35, the end wall and swirl members are moved longitudinally of the tip 81 by rotating the nozzle member relative to the pump member. The annular projection 80 is slidably received over the outer surfaces of the swirl members to assure that fluid flows through the spaces between the swirl members.

As seen in FIGS. 2 and 4, the finger engaging trigger 84 extends downwardly, rigidly and integrally from the remaining main body portion of the pump member and includes a planar, horizontal and rectangular finger guard 85 which extends outwardly therefrom below the housing. This finger guard has an upwardly facing surface 86 and a downwardly facing surface 87 as seen best in FIGS. 7 and 9 and prevents the operator's finger from rubbing on the housing during actuation of the trigger.

As seen in FIG. 7, the square portion 71 on the pump member has a pair of downwardly facing planar and horizontal surfaces 89 and 90 which are spaced above the upwardly facing surface 86 on the finger guard, thereby defining a pair of outwardly facing substantially planar slots in the pump member. Extending vertically between the downwardly facing surfaces 89 and 90 and the upwardly facing surface 86 are a pair of spaced vertical walls 91 and 92 as seen in FIGS. 2, 4, 9, and 11–13. Also extending between these surfaces is a front wall 94 as seen in FIGS. 4, 7 and 9. As seen in FIG. 12, the rear sections of these vertical walls 91 and 92 are slightly tapered at 95 to aid in insertion of the pump member into the housing. The fronts of these vertical walls 91 and 92 form stops to prevent the pump member from being removed inadvertently from the housing as will be described in more detail hereinafter.

A fluid passageway is thus formed in the pump member via cylindrical surfaces 46 and 48, ports 53–56, opposed cylindrical surfaces 75 and 77, and the spaces between splines 79.

Figure 5:
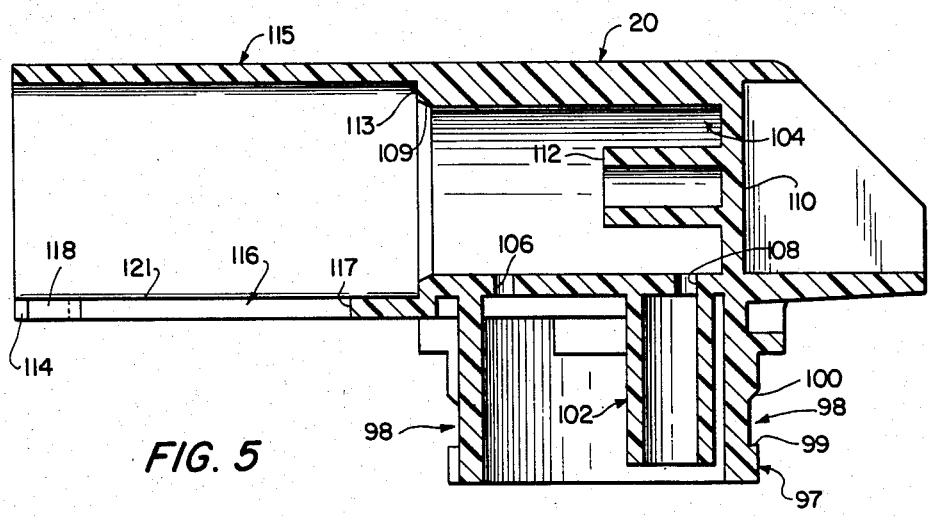
FIG. 5 is an elevational view in longitudinal section of the housing shown in FIGS. 1 and 2.

As seen in FIG. 5, the housing 20 is formed from plastic material as a one-piece member formed by injection molding. The housing has a downwardly extending substantially cylindrical portion 97, which is vertically interrupted by a recess for manufacturing purposes and has an outwardly facing horizontal groove 98 having an upwardly facing bottom substantially annular right angle shoulder 99 and a downwardly and inwardly tapering top substantially annular surface 100. Groove 98 receives therein an inwardly facing horizontal annular rib 101 on the cylindrical inner surface of the closure 22 in a snap fit, as seen in FIG. 2, the groove and rib having substantially the same cross section. In this snap fit, the outer and inner cylindrical surfaces on portion 97 and closure 22 are closely adjacent but allow for relative rotation, as do the rib and groove. This closure has an additional series of internal helical threads 103 to threadedly engage suitable threads on the top of the container 28. If necessary, a suitable gasket can be utilized between the housing and the container.

As seen in FIG. 5, there is a downwardly extending vertical cylindrical portion 102 for receiving the dip tube 24 therein in an interference fit, as seen in FIG. 2. This cylindrical portion 102 extends into a horizontally oriented cylindrical portion 104 which has a vertical vent port 106 on the bottom thereof forward of the cylindrical portion 102 and a vertical port 108 providing communication between the interior of cylindrical portion 104 and cylindrical portion 102. The inner surface of cylindrical portion 104 forms a valve seat as seen best in FIG. 2. At the front of the cylindrical portion 104 is an outwardly tapering frustoconical surface 109 and at the rear is a vertical wall 110 having a longitudinally extending horizontal cylindrical post 112 thereon. This post receives the inboard valve 18 thereon in an interference fit as seen in FIG. 2.

Figure 8:
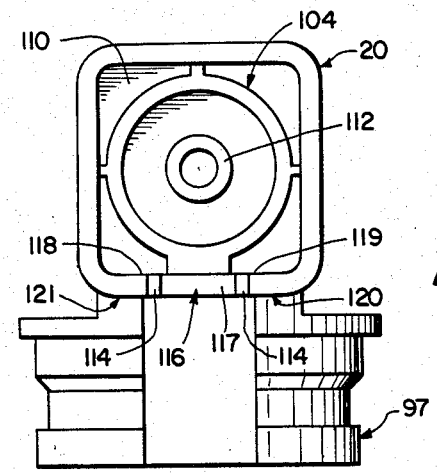
FIG. 8 is a front elevational view of the housing shown in FIG. 5.

Forward of the frustoconical surface 109 is an annular shoulder 113. A square portion 115 forms the exterior of the housing and has an open-ended slot 116 at the bottom, this slot having an end wall 117 and a pair of inwardly extending forward stops 118 and 119 as seen in FIGS. 1 and 8. These stops 118 and 119 have tapered forward edges 114 that engage with the tapers 95 on vertical walls 91 and 92 of the pump member to allow the pump member to be pushed into the slot 116, by biasing outwardly the bottom walls 120 and 121 forming the slot 116, as seen in FIGS. 1 and 8. These bottom walls 120 and 121 act as flanges for reception in the slots defined between the upper surface 86 on the finger guard 85 and the bottom surfaces 89 and 90 on the pump member as seen in FIGS. 7 and 9. These bottom walls are planar and horizontally oriented.

As is evident from FIG. 5, a fluid passageway is formed in the housing 20 along the cylindrical portion 102, port 108, and the cylindrical portion 104.

Figure 6:
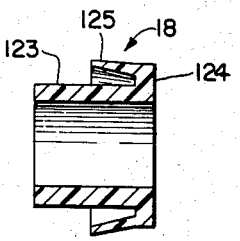
FIG. 6 is an elevational view in longitudinal section of the inboard valve shown in FIGS. 1 and 2.

Referring now to FIG. 6, the inboard valve 18 is formed from plastic material as a one-piece member formed by injection molding. The inboard valve basically comprises a cylindrical portion 123, a cylindrical rim 124 extending integrally and radially outwardly from one end of portion 123 and a frustoconical resilient valve member 125. As seen in FIG. 2, the cylindrical portion 123 of the inboard valve is supported on the cylindrical post 112 in an interference fit and the frustoconical valve member 125 overlies and closes port 108 above the dip tube 24. Valve member 125 is biased against cylindrical portion 104 which forms the valve seat.

ASSEMBLY OF THE PUMP DISPENSER

In assembling the pump dispenser 10 in accordance with the invention, the closure 20 is snapped onto the cylindrical portion 97 as seen in FIG. 2 so that the bottom shoulders and top surfaces on the rib and groove engage and the dip tube 24 is inserted in cylindrical portion 102 in the housing.

The inboard valve 18 is maneuvered through the open end of the housing 20 and fitted onto the cylindrical post 112 so that the frustoconical valve member 125 is flattened and biases against the cylindrical portion 104, thereby closing port 108.

The adjustable nozzle 12 is threaded onto the pump member 14 as seen in FIG. 2, the coiled spring 16 is maneuvered around cylindrical surface 65 and frustoconical surface 66 on the pump member and then the combination of the adjustable nozzle, pump member and coiled spring are inserted into the housing.

During such insertion, the bottom walls 120 and 121 of the housing are spread apart by engagement of the tapers 95 on the vertical walls 91 and 92 on the pump member until the vertical walls have been pushed past the stops 118 and 119 as seen in FIG. 2. In this position the stops engage the front ends of these vertical walls.

As seen in FIG. 2, upon insertion of the pump member into the housing, the lip seals 61 and 63 on the pump member slidably engage the inner surface of cylindrical portion 104 and the outer surface of the square portion 71 slidably engages the inner surface of the square portion 115 on the housing. In this position as seen in FIG. 7, the downwardly facing surfaces 89 and 90 on the square portion 71 are in slidable engagement with the upper surfaces of bottom walls 120 and 121 in the housing. Thus, any slidable motion of the pump member relative to the housing will be longitudinally aligned. In this regard, the torque and resulting bending moment applied to the trigger 84 upon engagement and movement of the pump member towards the housing, which would tend to downwardly distort the pump member via bending or pivoting and cause separation of the bottom walls of the slot, is absorbed by contact of the bottom planar surfaces of the square portion 71 with the planar walls 120 and 121. This alignment is aided by engagement of finger guard 85 with the bottom of walls 120 and 121 and by engagement of seals 61 and 63 and cylindrical surface 65 with cylindrical portion 104.

As seen in FIG. 2, the coiled spring 16 biases the pump member outwardly by means of engagement with annular shoulder 113 on the housing and the four splines 67–70 on the pump member. The inward extent of movement by the pump member relative to the housing is stopped by engagement of the vertical walls 91 and 92 with the end wall 117 of the housing as seen in FIGS. 2 and 12.

As seen in FIG. 2, the combination of the pump member inner surfaces and the inner surface of cylindrical portion 104 in the housing form a product chamber 127, which has a variable volume upon relative sliding motion of the pump member and the housing.

As seen in FIG. 2, when the adjustable nozzle 12 is threaded onto the pump member 14, the outboard valve 26 is formed by means of the frustoconical valve member 78 engaging and biasing against the annular surface 31 in the nozzle member.

OPERATION

As seen in FIG. 1, the pump dispenser 10 in accordance with the invention is in its rest, relaxed position with both one-way valves 18 and 26 being closed.

With liquid in the container 28 and the nozzle member open, the trigger 84 is engaged by the operator to pull the pump member 14 towards the housing in a longitudinally sliding movement as seen in FIG. 12. This movement causes the spring 16, which engages a portion of the pump member and the housing, to compress longitudinally as seen by comparing FIGS. 2 and 12 and also causes the expelling of air from the product chamber 127 past the outboard valve 26 and out the exit orifice 35 in the nozzle member. The outboard valve 26 opens under the air pressure created by this movement as the thin, resilient frustoconical valve member 78 is biased radially inwardly away from the engagement with cylindrical surface 31 in the nozzle member. The air then moves past the valve member 78 between the splines 79, through the spaces between the swirl members and out the exit orifice 35. Previously, this air moved from the product chamber 127 through ports 53–56 and into the space between the nozzle member and the pump dispenser defined between cylindrical surfaces 31 and the stem 77 as seen in FIG. 11.

Figure 13:
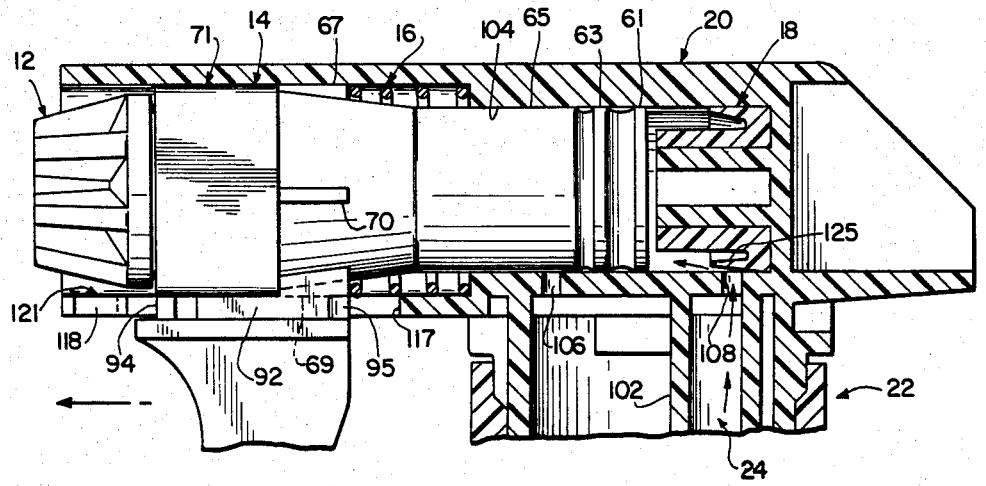
FIG. 13 is an elevational view in longitudinal section showing the pump dispenser with the inboard valve open, the pump member moving away from the housing and liquid being drawn from the container into the housing.

The operator's pressure on the trigger is then released and the stored potential energy in the spring 16 drives the pump member away from the housing as indicated in FIG. 13.

A partial vacuum is then formed in the product chamber 127 as the pump member moves away from the housing and thus liquid from the container moves into the product chamber past the inboard valve 18 as seen in FIG. 13. This valve opens since the thin, resilient frustoconical valve member 125 is driven away from the cylindrical portion 104 by the movement of the liquid into the product chamber. The liquid moves from the container 28 up the dip tube 24, through port 108, and then through the gap between the valve member 125 and cylindrical portion 104.

As seen in FIG. 13, movement of the lip seals 61 and 63 rearwardly exposes the vent port 106 to the atmosphere since there is some space between cylindrical surface 65 and cylindrical portion 104. In the rest position, as seen in FIG. 2, this vent port is closed via the two seals, thereby preventing possible leakage if the container is tilted or dropped.

When forward movement of the pump member is completed, the next movement of the pump member towards the housing will expel the liquid in the product chamber out the nozzle member 12 as seen in FIG. 12, as the outboard valve 26 again opens under the influence of the liquid moving past it.

EMBODIMENT OF FIG. 14

As seen in FIG. 14, the outboard valve 26' has been modified so that that frustoconical valve member 78' is integrally formed with the adjustable nozzle member 12' while the pump member 14' has a recess with an inwardly facing cylindrical surface 130 forming the valve seat. The remainder of the structure of the pump dispenser shown in FIG. 14 is substantially the same as that shown in FIG. 2 and like reference numerals have been supplied with the addition of primes as necessary.

As seen in FIG. 14, the frustoconical valve member 78' is radially outwardly facing and rearwardly directed into engagement with annular surface 130.

The operation of the outboard valve 26' is basically the same as described above regarding outboard valve 26 with the fluid opening the valve 26' by moving the frustoconical valve member 78' radially inwardly away from contact with the inner cylindrical surface 130 on the pump member.

EMBODIMENT OF FIG. 15

As seen in FIG. 15, the pump member 14'' is modified as is the housing 20' so that they are both cylindrical, the housing has a pair of inwardly directed planar and horizontal slots 131 and 132 and the pump member has a pair of outwardly directed planar and horizontal flanges 134 and 135 received respectively in the pair of slots. This structure assures that the pump member and the housing remain longitudinally aligned during movement of the pump member relative to the housing and also prevents the bending moment on the pump member caused by engagement of the trigger from distorting the pump member relative to an axis transverse of the housing in an attempt to separate the bottom walls of the housing defining the slot through which the trigger moves.

While various advantageous embodiments have been chosen to illustrate the invention, it will be understood by those skilled in the art that various changes and modifications can be made therein without departing from the scope of the invention as defined in the appended claims.

What is claimed is:

1. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said finger engaging trigger having a bottom edge free from engagement with said housing, said cooperating means comprising a substantially planar downwardly facing surface on said pump member and a substantially planar upwardly facing surface on said housing in slidable engagement with said downwardly facing surface.

2. The improvement according to claim 1, wherein the housing includes a cylindrical portion containing the vent therein, and the pump member includes a vent regulating portion in slidable engagement with the housing cylindrical portion for movement with the pump member from a first position sealing the vent from the atmosphere to a second position opening the vent to the atmosphere.

3. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said finger engaging trigger having a bottom edge free from engagement with said housing, said cooperating means comprising a pair of slots extending longitudinally on one of said pump member and said housing, and a pair of flanges extending longitudinally on the other of said pump member and said housing, said flanges each having a thickness substantially equal to the thicknesses of said pair of slots and being respectively received therein for slidable movement.

4. The improvement according to claim 3, wherein said pair of slots are located on said pump member, and said pair of flanges are located on said housing.

5. The improvement according to claim 3, wherein said pair of slots are located on said housing, and said pair of flanges are located on said pump member.

6. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said finger engaging trigger having a bottom edge free from engagement with said housing, said cooperating means comprising a portion of said housing having a substantially rectangular inner surface, and a portion of said pump member having a substantially rectangular outer surface which is in slidable engagement with said housing inner surface.

7. The improvement according to claim 6, wherein said cooperating means further comprises a slot extending longitudinally on one of said pump member and said housing, and a flange extending longitudinally on the other of said pump member and said housing, said flange having a thickness substantially equal to the thickness of said slot and being received therein for slidable movement.

8. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said cooperating means comprising a portion of said housing having a substantially rectangular inner surface, and a portion of said pump member having a substantially rectangular outer surface which is in slidable engagement with said housing inner surface, and a slot extending longitudinally on one of said pump member and said housing, and a flange extending longitudinally on the other of said pump member and said housing, said flange having a thickness substantially equal to the thickness of said slot and being received therein for slidable movement, a portion of said housing having a substantially cylindrical inner surface, and a portion of said pump member having a substantially cylindrical outer surface which is in slidable engagement with said housing inner surface.

9. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said finger engaging trigger having a bottom edge free from engagement with said housing, said trigger having an outwardly extending finger guard located below said housing for preventing a rubbing engagement between a finger engaging said trigger and said housing.

10. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said finger engaging trigger having a bottom edge free from engagement with said housing, said pump member comprising a nozzle member having a fluid passageway with said exit orifice located at the end thereof;

a main body portion having a fluid passageway therein;

means for adjustably coupling the nozzle member to the main body portion so that the fluid passageways in each communicate;

a recess having an annular surface formed by one of the main body portion and the nozzle member as a valve seat along the fluid passageway therein; and an annular, resilient valve member integrally formed with the other of the main body portion and the nozzle member and engaging said annular surface in said recess, thereby forming one of the one-way valves, said means for coupling including means for preventing relative longitudinal movement of said nozzle member and said main body portion during opening and closing of the one-way valve formed thereby, said nozzle member and said main body portion having cooperating means for varying the flow of fluid to be exhausted via said exit orifice upon adjusting the coupling of said nozzle member and main body portion.

11. The improvement according to claim 10, and further comprising a support extending integrally and downwardly on the housing and having a substantially cylindrical outer surface with an outwardly facing groove therein having an upwardly facing shoulder, said groove being spaced from the distal end of said cylindrical outer surface, and an annular closure having a cylindrical inner surface with an inwardly facing rib thereon having a downwardly facing shoulder, said rib being received in said groove via a snap-fit so that said upwardly and downwardly facing shoulders engage and so that said cylindrical inner and outer surfaces are closely adjacent one another while allowing relative rotation therebetween, said closure having means thereon for coupling said closure to the bottle.

12. In a pump dispenser having first means defining a fluid passageway, a dip tube extending from the fluid passageway into a container, second means for coupling the container to the first means, a vent formed in the first means and communicating with the interior of the container, an outboard one-way valve and an inboard one-way valve located along the fluid passageway and defining a product chamber therebetween, a finger engaging element coupled to the first means for movement from a first position to a second position to vary the volume of the product chamber, third means for biasing the finger engaging element from the second position to the first position, a nozzle member, and fourth means for coupling the nozzle member to the first means at the end of the fluid passageway, the improvement comprising:

said second means including a support extending integrally and downwardly on the first means and having a substantially cylindrical outer surface with first and second ends and with an outwardly facing groove therein having an upwardly facing shoulder, and groove being between and spaced from said first and second ends of said cylindrical outer surface, and an annular closure having a cylindrical inner surface with first and second ends and with an inwardly facing rib thereon having a downwardly facing shoulder, said rib being between and spaced from said first and second ends of said cylindrical inner surface, said rib being received in said groove via a snap-fit so that said upwardly and downwardly facing shoulders engage and so that said cylindrical inner and outer surface, both above and below said rib and groove, are closely adjacent one another while allowing relative rotation therebetween, said closure having means thereon for coupling said closure to the container.

13. The improvement according to claim 12 wherein said groove and said rib have substantially the same cross section.

14. The improvement according to claim 12, wherein said groove has a downwardly and inwardly tapered top surface, and said rib has a downwardly and inwardly tapered top surface which tapers at an angle substantially the same as said tapered top surface on said groove.

15. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved toward said housing, said cooperating means being located within the fluid passageway in the housing.

16. The improvement according to claim 15, wherein said cooperating means comprises a substantially planar downwardly facing surface on said pump member and a substantially planar upwardly facing surface on said housing in slidable engagement with said downwardly facing surface.

17. The improvement according to claim 15, wherein said cooperating means comprises a pair of slots extending longitudinally on one of said pump member and said housing, and a pair of flanges extending longitudinally on the other of said pump member and said housing, said flanges each having a thickness substantially equal to the thicknesses of said pair of slots and being respectively received therein for slidable movement.

18. The improvement according to claim 15, wherein said cooperating means comprises a portion of said housing having a substantially rectangular inner surface, and a portion of said pump member having a substantially rectangular outer surface which is in slidable engagement with said housing inner surface.

19. The improvement according to claim 18, wherein said cooperating means further comprises a slot extending longitudinally on one of said pump member and said housing, and a flange extending longitudinally on the other of said pump member and said housing, said flange having a thickness substantially equal to the thickness of said slot and being received therein for slidable movement.

20. The improvement according to claim 19, wherein said cooperating means further comprises a portion of said housing having a substantially cylindrical inner surface, and a portion of said pump member having a substantially cylindrical outer surface which is in slidable engagement with said housing inner surface.

21. The improvement according to claim 15, wherein said pump member comprises a nozzle member having a fluid passageway with said exit orifice located at the end thereof;

a main body portion having a fluid passageway therein;

means for adjustably coupling the nozzle member to the main body portion so that the fluid passageways in each communicate;

a recess having an annular surface formed by one of the main body portion and the nozzle member as a valve seat along the fluid passageway therein; and an annular, resilient valve member integrally formed with the other of the main body portion and the nozzle member and engaging said annular surface in said recess, thereby forming one of the one-way valves, said means for coupling including means for preventing relative longitudinal movement of said nozzle member and said main body portion during opening and closing of the one-way valve formed thereby, said nozzle member and said main body portion having cooperating means for varying the flow of fluid to be exhausted via said exit orifice upon adjusting the coupling of said nozzle member and main body portion.

22. The improvement according to claim 21, and further comprising a support extending integrally and downwardly on the housing and having a substantially cylindrical outer surface with an outwardly facing groove therein having an upwardly facing shoulder, said groove being spaced from the distal end of said cylindrical outer surface, and an annular closure having a cylindrical inner surface with an inwardly facing rib thereon having a downwardly facing shoulder, said rib being received in said groove via a snap-fit so that said upwardly and downwardly facing shoulders engage and so that said cylindrical inner and outer surfaces are closely adjacent one another while allowing relative rotation therebetween, said closure having means thereon for coupling said closure to the bottle.

23. The improvement according to claim 15, wherein the housing includes a cylindrical portion containing the vent therein, and the pump member includes a vent regulating portion in slidable engagement with the housing cylindrical portion for movement with the pump member from a first position sealing the vent from the atmosphere to a second position opening the vent to the atmosphere.

24. In a manually-operated pump dispenser including a housing adapted to be coupled to a liquid-containing bottle and having a fluid passageway, a dip tube extending from the passageway into the bottle, an open-ended slot, and a vent for venting the bottle to the atmosphere; a pump member having a fluid passageway communicating with the fluid passageway in the housing, and a finger engaging trigger extending therefrom and movable in the slot, the pump member being slidably engaged with the housing and having an exit orifice; means for biasing the pump member away from the housing; and a pair of one-way valves located along the pump member and the housing fluid passageways, the improvement comprising:

cooperating, substantially planar means on said housing and said pump member for maintaining said pump member and said housing in longitudinal alignment when said trigger is engaged and said pump member is moved towards said housing, said pump member having a longitudinal axis, said cooperating means comprising a first set of slidably engaging planar surfaces located within said housing and on one side of the longitudinal axis of said pump member, and a second set of slidably engaging planar surfaces located within said housing and on the other side of the longitudinal axis of said pump member, said finger engaging trigger extending downwardy from said pump member and located in a first plane, said first and second sets of planar surfaces being located in a second plane that is perpendicular to the first plane in which said finger engaging trigger is located.

25. The improvement according to claim 24, wherein said cooperating means further comprises a slot extending longitudinally on one of said pump member and said housing, and a flange extending longitudinally on the other of said pump member and said housing, said flange having a thickness substantially equal to the thickness of said slot and being received therein for slidable movement.

26. The improvement according to claim 25, wherein said cooperating means further comprises a portion of said housing having a substantially cylindrical inner surface, and a portion of said pump member having a substantially cylindrical outer surface which is in slidable engagement with said housing inner surface.

27. The improvement according to claim 24, wherein said pump member comprises a nozzle member having a fluid passageway with said exit orifice located at the end thereof;

a main body portion having a fluid passageway therein;

means for adjustably coupling the nozzle member to the main body portion so that the fluid passageways in each communicate;

a recess having an annular surface formed by one of the main body portion and the nozzle member as a valve seat along the fluid passageway therein; and an annular resilient valve member integrally formed with the other of the main body portion and the nozzle member and engaging said annular surface in said recess, thereby forming one of the one-way valves, said means for coupling including means for preventing relative longitudinal movement of said nozzle member and said main body portion during opening and closing of the one-way valve formed thereby, said nozzle member and said main body portion having cooperating means for varying the flow of fluid to be exhausted via said exit orifice upon adjusting the coupling of said nozzle member and main body portion.

28. The improvement according to claim 27, and further comprising a support extending integrally and downwardly on the housing and having a substantially cylindrical outer surface with an outwardly facing groove therein having an upwardly facing shoulder, said groove being spaced from the distal end of said cylindrical outer surface, and an annular closure having a cylindrical inner surface with an inwardly facing rib thereon having a downwardly facing shoulder, said rib being received in said groove via a snap-fit so that said upwardly and downwardly facing shoulders engage and so that said cylindrical inner and outer surfaces are closely adjacent one another while allowing relative rotation therebetween, said closure having means thereon for coupling said closure to the bottle.

29. The improvement according to claim 24, wherein the housing includes a cylindrical portion containing the vent therein, and the pump member includes a vent regulating portion in slidable engagement with the housing cylindrical portion for movement with the pump member from a first position sealing the vent from the atmosphere to a second position opening the vent to the atmosphere.

* * * * *